United States Patent [19]

Healy

[11] Patent Number: 4,724,778

[45] Date of Patent: Feb. 16, 1988

[54] AIR CONTROL FOR COMBUSTOR

[75] Inventor: John T. Healy, Irvine, Calif.

[73] Assignee: Westinghouse Electric Corp., Pittsburgh, Pa.

[21] Appl. No.: 942,570

[22] Filed: Dec. 15, 1986

[51] Int. Cl.[4] ..... A47J 36/24; F27B 7/36

[52] U.S. Cl. ..... 110/246; 432/103; 432/107; 432/77

[58] Field of Search ..... 432/103, 105, 107, 112, 432/113, 117; 110/246

[56] References Cited

U.S. PATENT DOCUMENTS

| | | | |
|---|---|---|---|
| 3,822,651 | 7/1974 | Harris et al. | 110/246 |
| 4,038,021 | 7/1977 | Benson | 432/107 |
| 4,125,437 | 11/1978 | Bacon | 432/107 |
| 4,226,584 | 10/1980 | Ishikawa | 432/116 |
| 4,266,931 | 5/1981 | Struckmann | 110/246 |
| 4,345,894 | 8/1982 | Smith et al. | 110/245 |
| 4,349,969 | 9/1982 | Stewart | 110/245 |
| 4,352,332 | 10/1982 | Baston | 110/245 |
| 4,457,081 | 7/1984 | von Wedel | 432/77 |

*Primary Examiner*—Henry C. Yuen

*Attorney, Agent, or Firm*—F. J. Baehr, Jr.

[57] ABSTRACT

A rotary combustor, in which material is burned in a gas porous cylinder, having a sectioned and compartmented wind box permitting selective delivery of air through the burning material, above the burning material, at the start of the burning process, and after burning has been well initiated.

1 Claim, 3 Drawing Figures

AIR CONTROL FOR COMBUSTOR

This invention relates generally to a kind of kiln known as a rotary combustor, and more particularly concerns a combustor air supply.

A rotary combustor of the kind generally described in U.S. Pat. No. 3,822,651, issued June 9, 1974, has been found very effective in burning municipal solid waste (MSW) while generating useful steam during the process. A characteristic of MSW is that its makeup, in terms of being combustible, varies widely and unpredictably.

When burning a substantially homogenous fuel like coal or oil, the supply of combustion air can be planned for efficient and complete burning. However, when burning MSW, conventional practice has been to supply combustion air in large volumes, far more than is actually needed for the burning reaction. There are a number of reasons for this. The MSW normally contains considerable moisture which must be driven off. Also, it must be assumed that volatiles will be present in, or easily releasable from, MSW so that adequate air is required to prevent the creation of an explosive environment. And it is desirable to maintain an air supply sufficient to avoid the creation of a reducing atmosphere in the burning zone, since such an atmosphere is highly corrosive to ferrous boiler components.

As a result of these factors, it is not uncommon to supply, when burning MSW, 200% more air than is actually utilized. This excess air imposes a significant energy load on a burning system, since combustion air must be heated and then cooled. If the air is not actually used in the burning reaction, the energy used is wasted.

It is the primary aim of the invention to provide a rotary combustor air control that substantially minimizes waste resulting from the supplying of excess air, since the control permits operation utilizing only about 50% excess air.

Another object of the invention is to provide an air control as characterized above that permits selective control of underfire air and overfire air, as well as giving zone control of air flow for different stages of burning.

A further object is to provide an air control of the foregoing kind that utilizes some of the characteristics of a rotary combustor to make the control economical and reliable.

Other objects and advantages of the invention will become apparent upon reading the following detailed description and upon reference to the drawings, in which.

Figure 1:
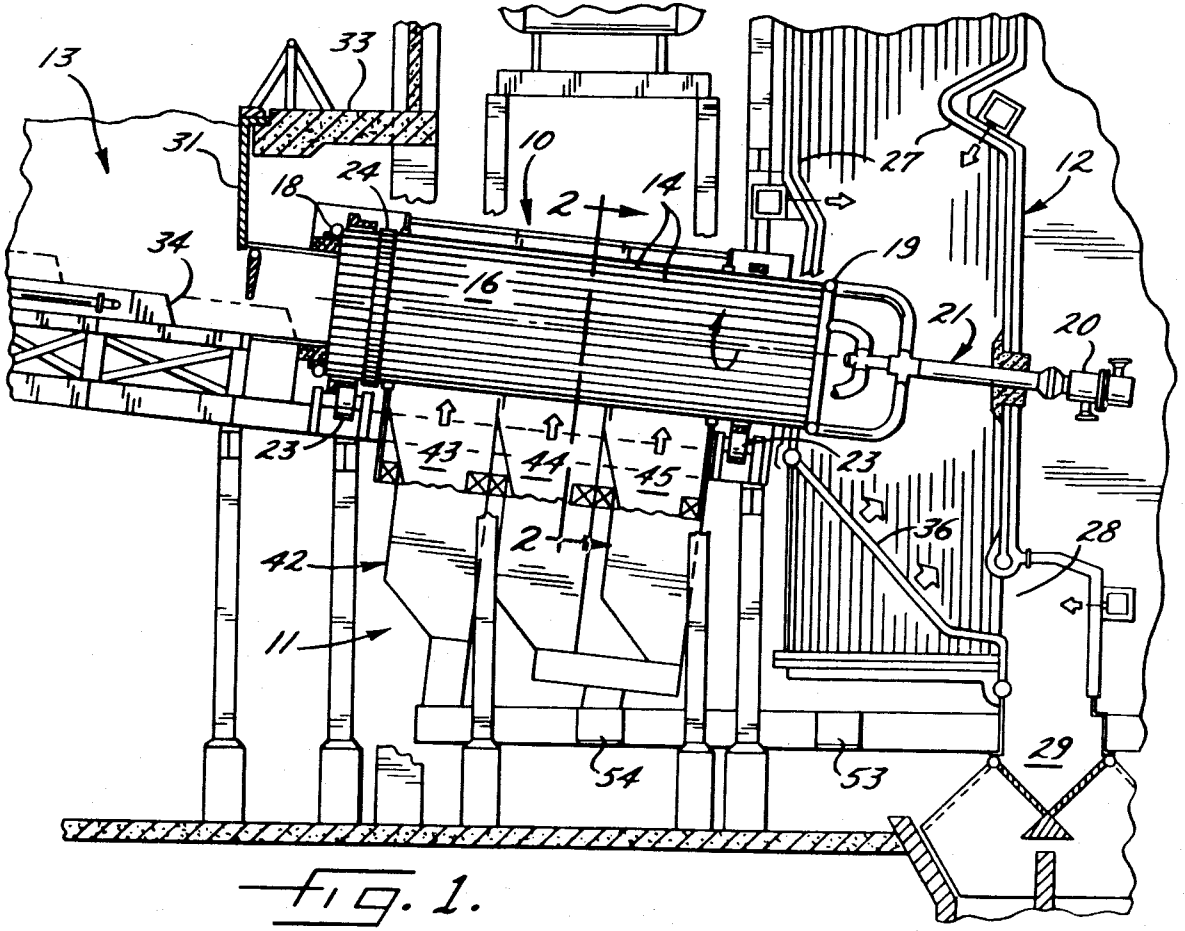
FIG. 1 is a fragmentary partially sectioned elevation of a structure for burning MSW including a rotary combustor embodying the invention.
Figure 2:
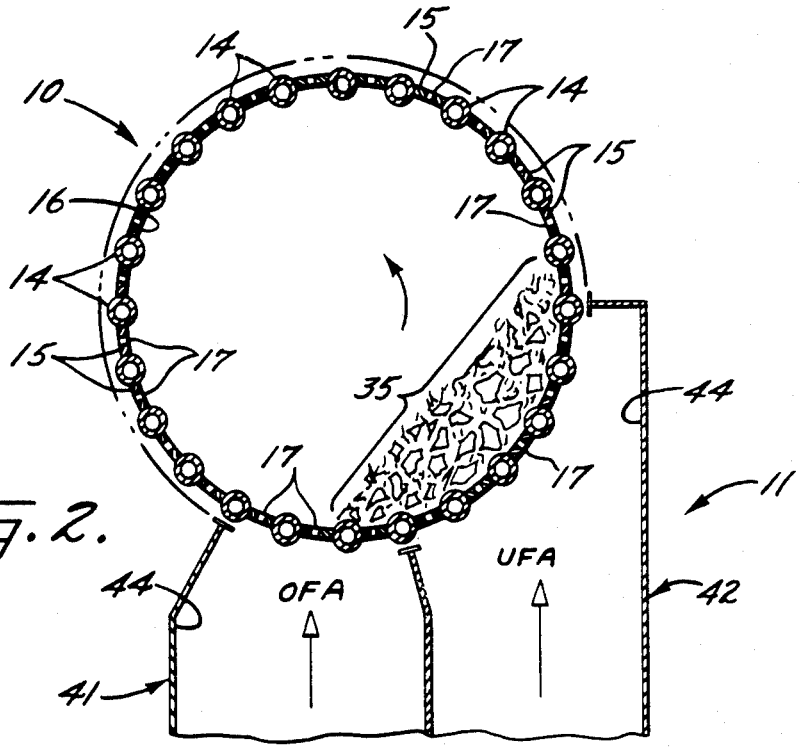
FIG. 2 is an enlarged fragmentary section taken approximately along the line 2—2 in FIG. 1.

While the invention will be described in connection with a preferred embodiment, it will be understood that I do not intend to limit the invention to that embodiment. On the contrary, I intend to cover all alternatives, modifications and equivalents included within the spirit and scope of the invention as defined by the appended claims.

Turning to the drawings, there is shown a structure for burning material such as MSW and including a rotary combustor 10 with a wind box 11 for delivering air to the combustor 10, a furnace 12, and an arrangement 13 for feeding combustible material into the combustor. The combustor 10 is formed of a plurality of water cooled pipes 14 joined together by perforated strips 15 welded between the pipes to define the cylinder 16 having a gas porous wall. The perforations in the strips 15 consist of a plurality of holes 17 running the length of the cylinder 16.

The pipes 14 end in annular header pipes 18 and 19 at each end of the cylinder. A rotary joint 20 feeds water to, and removes steam and hot water from, the combustor 10 through concentric pipes 21. Water is directed to the header pipe 19, and thence to the combustor pipes 14, and steam from the header pipe 18 is carried back through certain ones of the combustor pipes 14 that do not carry water and which communicate directly with the steam portion of the pipes 21.

The combustor 10 is mounted for rotation about the axis of the cylinder 16 on support rollers 23 with the axis being tilted so that the cylinder has a high and a low end. And the combustor 10 is slowly rotated through a sprocket 24 in the direction of the arrows.

The furnace 12 is defined by a plurality of boiler pipes 27 having a side opening for the combustor and a bottom opening 28 leading to a chute 29 for ashes and nonburnable materials. The arrangement 13 for feeding combustible material includes a chamber 31 beneath the level of a floor 33 from which material can be dumped. A reciprocating ram 34 at the bottom of the chamber 31 positively feeds material into the upper open end of the combustor cylinder 16.

As observed above, a basic combustor is further disclosed in said U.S. Pat. No. 3,822,651, and a waste feeding ram is disclosed in Serial No. 07/000510, filed Jan. 5, 1987; both of which disclosures are hereby incorporated by reference.

In operation, MSW fed into the cylinder 16 by the ram 34 is ignited from the formerly fed and burning material in the combustor and, because of the slow rotation of the cylinder 16, the material tends to pile up and tumble in an arcuate portion 35 of the cylinder 16 to one side of the center line. Because of the slight tilt of the cylinder, the burning material also gradually moves from the high end to the low end of the cylinder. Ash, and material in the MSW that will not burn, is eventually spilled from the lower end of the cylinder onto an inclined grate 36 in the furnace which leads to the chute 29.

In accordance with the invention, combustion air to the combustor 10 is controlled by the wind box 11 which is partitioned into two sections 41 and 42 supplying, respectively, overfire air and underfire air, and each section is divided into compartments 43, 44 and 45 delivering air at different longitudinal portions of the cylinder 16, thereby permitting selective variation of the air flow. The underfire air section 42 of the wind box 11 is configured for delivering air to the outer wall of the cylinder 16 and driving that air through the material being burned in the arcuate portion 35. The overfire air section 41 of the wind box 11 is configured for delivering air adjacent to the arcuate portion 35 of the cylinder in which the material is tumbling so that air is driven over the burning material.

Figure 3:
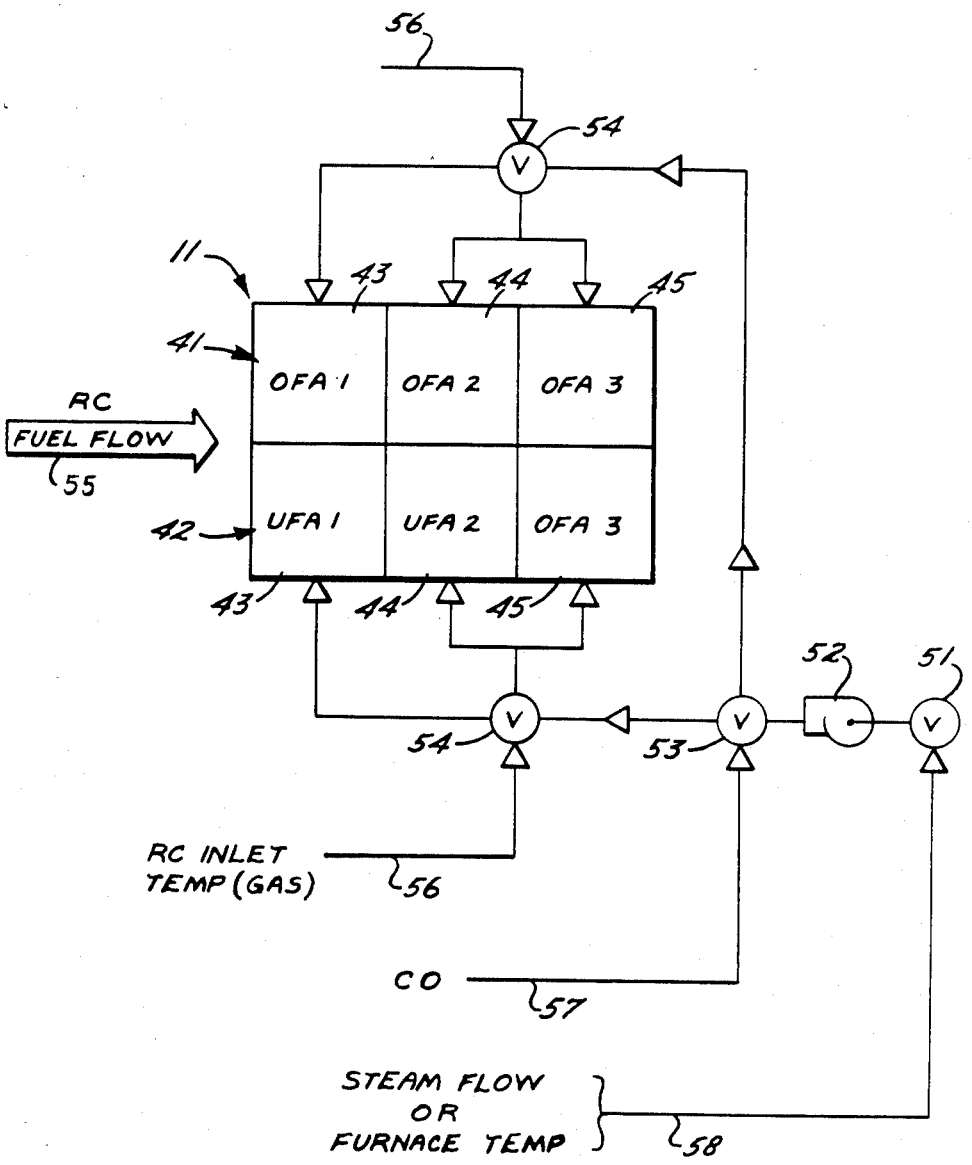
FIG. 3 is a schematic of the air flow and control associated with the structure shown in FIG. 1.

One way of utilizing the air control is suggested in FIG. 3 wherein an air valve 51 controls the intake, and hence the outflow, of air to a blower 52. A diverter valve 53 partitions the air from the blower 52 between the underfire and overfire wind box sections 41, 42, and a pair of diverter valves 54 further partitions the air going to each wind box section between the first compartments 43 at the high end of the combustor and compartments 44, 45 at the middle and lower end of the combustor. The flow of fuel into the combustor, i.e., the MSW delivered by the ram 34, is in the direction of the arrow 55.

Some first requirements of the air flow are to drive off moisture in the MSW, and to burn off volatiles with adequate air to prevent development of an explosive environment as might be the case if volatiles are driven off into an oxygen starved atmosphere. This result is accomplished by directing air to the compartments 43 at the top or inlet end of the combustor cylinder 16. If burning becomes too intense in this region, i.e., the burning becomes "too short" considering the length of the combustor, a sensing of the resulting elevated temperatures in this region exerts, on control paths 56, a signal varying the position of the valves 54 to shunt less air to the sections 43 and more to the following sections 44, 45.

The underfire air permeates the material being burning and initiates burning. The burning is completed efficiently by the overfire air. If an increase in carbon monoxide is detected in the development of a corrosive reducing atmosphere, a signal on path 57 varies the position of the valve 53 and sends more air to the overfire air section 41.

The total output of the combustor measured in terms of steam flow or furnace temperature develops a signal on control path 58 to adjust the air input through the valve 51 to the total system and thus modifies the total rate of combustion. This is similar to controlling the output of a coal fired furnace.

As a result of this kind of control, it is entirely feasible to adjust the air supplied to the combustor 10 to much more closely approximate the actual amount of oxygen utilized in the combustion process. This is to be contrasted with the more conventional practice of insuring adequate air by supplying far more than is actually needed, which practice results in large volumes of air being heated and then cooled which are not actually necessary for completing combustion.

The selective control of underfire and overfire air, as well as the provision of controlling air in different longitudinal zones of the combustor is of course what makes the efficient air control possible.

The operating characteristics of a rotary combustor are also conducive to this efficient air control. The material being burned moves through an initial region where moisture and volatiles are driven off and then through subsequent regions where what is essentially carbon is being burned. Also, the material is continuously being tumbled and agitated which facilitates the delivery of underfire combustion air. The porous nature of the combustor walls also permits air to be delivered directly into the region of its intended function.

I claim as my invention:

1. A rotary combustor for burning municipal solid waste comprising, in combination, a plurality of water cooled pipes and perforated intermediate strips joining said pipes defining a cylinder having a gas porous wall, means for mounting and rotating said cylinder about its axis, said axis being slightly tilted so the cylinder has a high end and a low end, means for feeding municipal solid waste into said high end of said cylinder so that the municipal solid waste, as it burns tumbles in an arcuate portion of the cylinder and gradually moves from the high end to the low end of the cylinder along said arcuate portion, a wind box for delivering air to the outer wall of said cylinder and driving air through said porous wall, said wind box being partitioned into sections so that a first section drives air into said arcuate portion and through the municipal solid waste, and a second section drives air adjacent said arcuate portion and over said municipal solid waste, and means for varying the air supplied to each of said sections, said first and second sections being further partitioned across the length of the rotary combustor to vary the quantity of air being supplied to the upper and lower ends of the rotary combustor, whereby the quantity of air driven through said municipal solid waste and the quantity of air supplied adjacent said municipal solid waste can be individually controlled at the upper and lower ends of the rotary combustor to properly burn said municipal solid waste irrespective of its makeup with a minimum amount of excess air.

* * * * *